United States Patent [19]

Bramblett et al.

[11] Patent Number: 4,682,539

[45] Date of Patent: Jul. 28, 1987

[54] CAN CRUSHER

[76] Inventors: Earl C. Bramblett, 705 Bullett Ave., SE., Roanoke, Va. 24013; Warren E. Clem, Rt. 1, Box 887, Vinton, Va. 24179

[21] Appl. No.: 287,904

[22] Filed: Jul. 29, 1981

[51] Int. Cl.[4] ..... B30B 9/32

[52] U.S. Cl. ..... 100/265; 100/295; 100/902

[58] Field of Search ..... 100/902, 295, 265, 116, 100/90, 65; 404/133; 241/99, 270, 169.2; D7/101; D21/222; D8/14, 75, 78, 80; D15/123, 20, 168, 169; 116/110 R; 72/479

[56] References Cited

U.S. PATENT DOCUMENTS

| | | | |
|---|---|---|---|
| D. 35,130 | 9/1901 | Allison | D8/14 |
| D. 256,770 | 9/1980 | Broyles | D7/101 |
| 2,248,108 | 7/1941 | Mihalko | 100/265 X |
| 2,994,262 | 8/1961 | Bator | 100/65 |
| 3,062,130 | 11/1962 | Huber et al. | 100/295 X |
| 3,434,411 | 3/1969 | Allen et al. | 100/90 |
| 3,565,351 | 2/1971 | Ross | 100/902 X |
| 3,988,978 | 11/1976 | Flick | 100/902 X |
| 4,088,072 | 5/1978 | Wittmeier | 100/295 X |
| 4,133,261 | 1/1979 | Belfils | 100/902 X |
| 4,197,796 | 4/1980 | Salatka | 100/902 X |
| 4,208,960 | 6/1980 | Leitgeb | 100/902 X |
| 4,228,734 | 10/1980 | Parrish | 100/902 X |

FOREIGN PATENT DOCUMENTS

| | | | |
|---|---|---|---|
| 1237688 | 6/1971 | United Kingdom | 100/902 |

*Primary Examiner*—Billy J. Wilhite

*Attorney, Agent, or Firm*—Millen & White

[57] ABSTRACT

A manually-operated device specifically for crushing cans, such as aluminum cans, includes a relatively heavy tramping element which is connected to an elongated handle, whereby when the tramping element is held over a can and driven downward, the can is crushed.

The tramping element may include either a groove or rib for venting air that may become compressed in the can as the can is crushed.

1 Claim, 6 Drawing Figures

CAN CRUSHER

BACKGROUND OF THE INVENTION

I. Field of the Invention

This invention is in the field of recovery and recycling scrap material. More particularly, it is concerned with compressing used, disposable, aluminum cans into more convenient condition for future recycling. Still more particularly, it is concerned with a device for compressing empty aluminum cans into substantially flat configurations.

II. Description of the Prior Art

In recent times there has been, particularly in the beverage industry, a move toward the use of aluminum or aluminum alloys as the material of choice for the manufacture of containers. These containers are manufactured by stamping a slug of aluminum into a unitary, elongated, cup shaped receptacle. This receptacle is filled with the desired beverage or the like and then a cap is applied and permenately affixed thereto.

In view of the energy crisis presently being experienced in this country, it has been found economically desirable to recycle these aluminum containers. Recycling centers have been established in most localities by the aluminum companies. At these recycling centers, the collected cans are weighed and the collection are paid by weight for the material gathered. One of the problems that has been encountered by both those collecting the used containers and by the recycling centers is the large volume of space occupied by the recyclable container relative to the weight involved. It has been found desirable to compact the aluminum container into as small a volume as possible to provide ease of handling and storage.

In the prior art of can or container compacting various devices employing types of mechanical advantage have been used to compact cans or containers. These devices are stationary and are actuated by the application of force by manual means or by pneumatic means.

III. Prior Art Statement

In the opinion of the applicant, U.S. Pat. Nos. 4,133,261, 4,197,796, 4,208,960 and 4,228,734 constitute the most relevant prior art of which the applicant are aware.

SUMMARY OF THE INVENTION

It is an object of the present invention to provide a relatively simple, readily transportable device for compacting aluminum cans or containers. It is a further object of this invention to provide an aluminum can compactor which can be easily carried by the person collecting cans and can be used at the situs of the can to compress it into a readily transportable element. It is a still further object of this invention to provide an aluminum can compactor which can be actuated by one hand of the operator, and which will effectively reduce the volume of a can so that a large number of them will occupy a minimum of space, thereby allowing an aluminum can collector to accumulate a large number of compacted cans in a single container such as a trash bag or the like.

BRIEF DESCRIPTION OF THE DRAWINGS

These and other of the invention and a better understanding of the principles and details of the invention will be evident from the following description taken in conjunction with the appended drawings in which.

DESCRIPTION OF THE PREFERRED EMBODIMENTS

Figure 1:
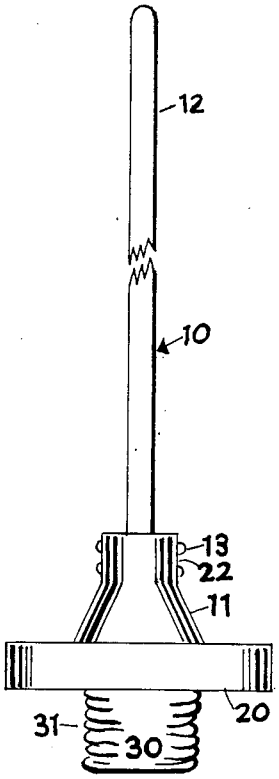
FIG. 1 is a front elevational view of the compacting device.
Figure 2:
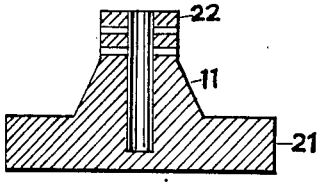
FIG. 2 in a cross-sectional view of the ramming head of the compacting device.

Referring now to the drawings there is indicated generally a device 10 for compacting aluminum cans. The device 10 comprises a ramming head 11 secured to a handle 12 by fasteners 13. The fasteners 13 may be rivets, bolts or the like. The handle 12 is preferably of a rigid material such as wood, plastic or metal. The ramming head 11 is preferably of cast iron, but can be machined of iron or steel or formed of any suitably dense material such as wood or plastic.

The ramming head of 11 is preferably formed as a unitary structure having a generally circular bottom portion 20. A rim 21 extends upwardly from the bottom portion 20. The upper portion 22 of the ramming head has a reduced cross-sectin and is secured to the handle 12 by fastening means 13. The diameter of the bottom portion 20 of the ramming head 11 is approximately twice that of a conventional can to be crushed.

In operation, a can 30 is disposed in upright position on the ground or any suitably firm surface. The handle 12 of the compacting device 10 is grasped by the operator and the device 10 is lifted above the can to be compacted by a distance which can readily be found by experiment to be suitable for the particular can being compacted. The relatively heavy tramping element or ramming head 11 suspended by the elongated handle 12 has a plumb line effect which helps aim the manual impulse and insure that the impulse has an almost completely vertical force component. The compacting device 10 is driven downwardly so that the bottom portion 20 contacts the top of the upright can. The kenetic energy of the compacting device 10 serves to collapse the thin side wall 31 of the can, compacting it into a compact, substantially flat configuration. The compacted cans can then be placed in any suitable container such as a trash bag for storage and transport to a recycling area. It has been found that approximately 600 compressed cans can be easily accomodated in a standard 30 gallon trash bag.

Figure 3:
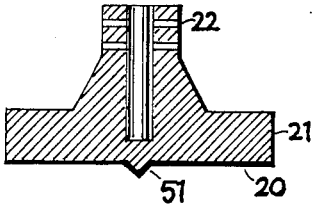
FIG. 3 is a cross-sectional view of the second embodiment of the ramming head.
Figure 5:
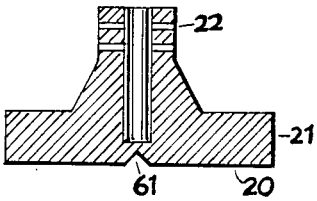
FIG. 5 is a cross-sectional view of a third embodiment of the ramming head.
Figure 4:
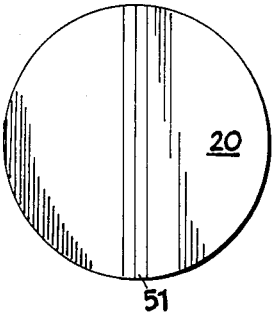
FIG. 4 is a bottom view of the ramming head embodiment of FIG. 3.
Figure 6:
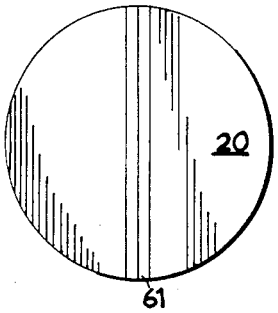
FIG. 6 is a bottom view of the ramming head of FIG. 5.

In the course of the present invention it has been discovered that the crushing of the can is impeded slightly by the presence of air in the can. Referring to FIG. 3 and FIG. 5, there are shown modifications of the present invention. As shown in FIG. 3 the ramming head is provided with a projection 51 extending across the surface of the bottom portion 20. In FIG. 5 the bottom portion 20 of the ramming head is provided with a grove 61. The projection and the grove each provide a passageway for the air contained within the collapsing can to be expelled relieving opposition to the crushing action.

We claim:

1. A manually operated device specifically for compacting aluminum throw-away beverage cans, the device comprising:

a relatively heavy tramping element made of cast iron and having a top portion and a substantially planar, circular bottom surface; wherein the bottom surface is used for crushing cans upon application of a manually applied vertical impulse to the tramping element, wherein the bottom surface has a diameter approximately twice that of the beverage cans, and wherein there is a lateral groove extending across the bottom surface for venting air from cans that are crushed; the tramping element further having a projecting sleeve extending from the top portion, which projecting sleeve defines a socket that projects down into the tramping element in a direction normal to the planar surface, aligned holes through the sleeve communicating with the socket for inserting fastening pins;

an elongated wooden handle having a connecting end secured in the socket of the tramping element and extending perpendicular to the planar bottom surface of the tramping element, in a direction away from the planar bottom surface, pin-type fastening means extending through the holes and through the elongated wooden handle to fasten the handle to the tramping element, said elongated handle having a free end opposite said connecting end, which free end is held in one hand of the person using the device to suspend the tramping element over singular cans, whereby the weight of the tramping element suspended by the elongated handle has a plumb-line effect which positions the tramping element over the can thereby helping to aim the tramping element and to insure that the manual impulse applied has an almost completely vertical force component.

* * * * *